United States Patent [19]

Rouse

[11] 4,019,452

[45] Apr. 26, 1977

[54] CAN END FEED MECHANISM

[75] Inventor: John W. Rouse, Fairlawn, N.J.

[73] Assignee: American Can Company, Greenwich, Conn.

[22] Filed: May 6, 1976

[21] Appl. No.: 683,935

[52] U.S. Cl. ..... 113/114 BE; 214/1 BB; 221/268

[51] Int. Cl.[2] ..... B21D 43/00; B21D 43/16

[58] Field of Search .... 113/114 A, 114 B, 114 BA, 113/114 BB, 114 BC, 114 BD, 114 BE, 114 R; 221/268, 276, 292, 293; 214/1 BB

[56] References Cited

UNITED STATES PATENTS

| | | | |
|---|---|---|---|
| 1,013,344 | 1/1912 | Wegner et al. | 113/114 BE |
| 1,133,383 | 3/1915 | Kreese | 113/114 BD |
| 1,750,391 | 3/1930 | Coyle et al. | 113/114 BG |
| 2,332,531 | 10/1943 | Robinson et al. | 113/114 BA |
| 2,386,845 | 10/1945 | Diezel | 113/114 BA |
| 3,702,103 | 11/1972 | Price et al. | 113/114 BE |

*Primary Examiner*—Leon Gilden
*Attorney, Agent, or Firm*—Robert P. Auber; Ira S. Dorman; George P. Ziehmer

[57] ABSTRACT

A feed mechanism for can ends having curled, peripheral edge portions includes means for disposing a multiplicity of can ends in a stack, and gate means for providing underlying support for the ends disposed in said stacking means and for individually releasing ends therefrom. The gate means employs a pair of blades to successively separate the lowermost end from the stack, each of which blades is configured and adapted to provide smooth separation of the ends, and avoid damage thereto. The mechanism is particularly suited for high-speed operation.

18 Claims, 10 Drawing Figures

FIG. 1
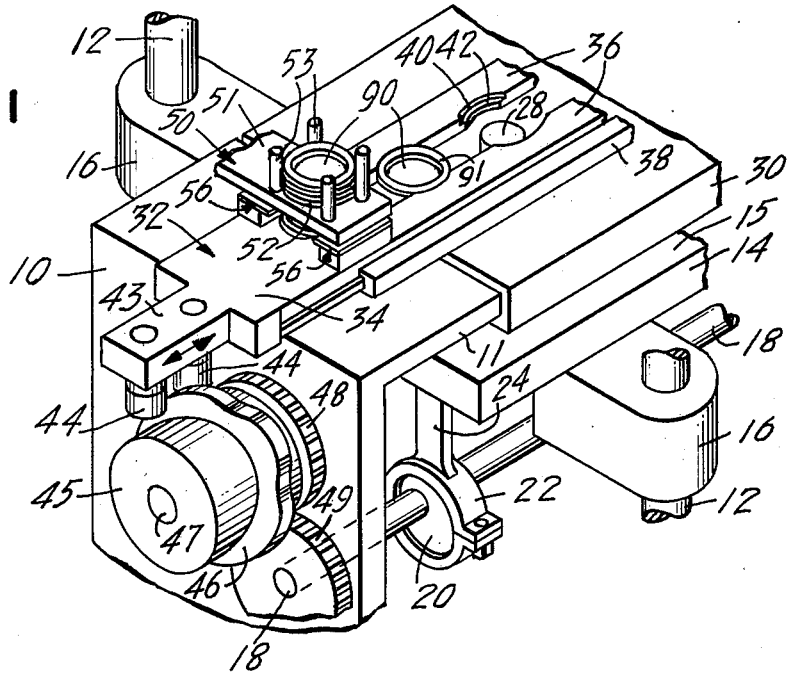
FIG. 2
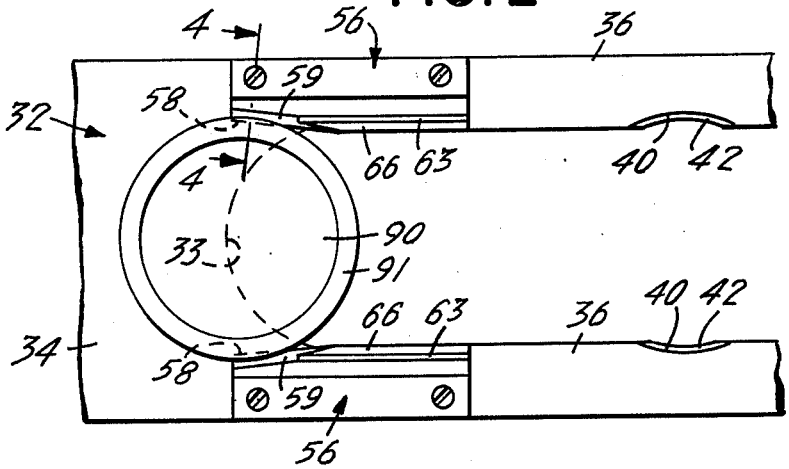
FIG. 4
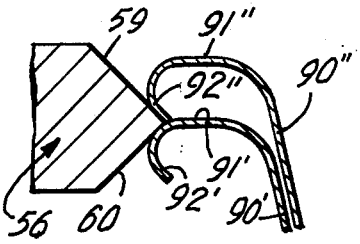
FIG. 5
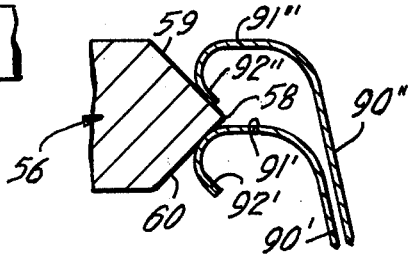
FIG. 3
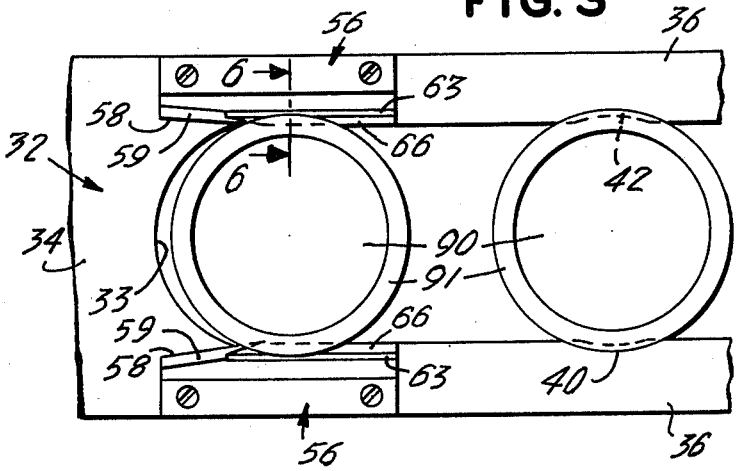
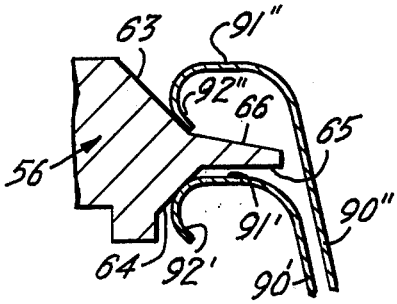
FIG. 6

CAN END FEED MECHANISM

BACKGROUND OF THE INVENTION

Various types of mechanisms have previously been employed to individually feed can ends and, more particularly, can ends have curled peripheral edge portions, from a stack. Such mechanisms are typically employed to feed ends to a forming press in which various forming operations are sequentially performed thereon. Conventionally, the ends, which are supported upon one another in the stack by their curled peripheral edge portions in nested relationship, are successively released from the bottom of the stack, by means of a pair of oppositely reciprocating separator knives, which are disposed to pass between the lowermost end and the one above it, so as to permit release of the lowermost end while simultaneously providing support for the remainder of the stack. More recently, a novel mechanism has been developed in which a pair of separator knives move together on a feed bar through a stack of ends to effect separation of one end at a time. In any event, because of normal variances in vertical registration of the knives with the stacked ends (resulting, for example, from differences in the degree of compression of the ends in the stack or from slight variations in their dimensions, due to forming, handling, etc.), the knives typically employed initiate separation by contact on their sharp leading edges, which tends to cause cutting of the edge curl of either the lowermost end or the one adjacent it, causing damage thereto and precluding smooth separation; in some instances, such interference causes jamming of the mechanism, particularly when it is operated at high speeds.

While attempts have in the past been made to alleviate the above-noted deficiencies, as far as is known, no such attempt has been entirely satisfactory. Among the drawbcks of the prior art mechanisms are included undue complexity of design and operation, inefficiency, insufficient speed, and inadequate smoothness of operation.

Accordingly, it is an object of this invention to provide a novel can end feeding mechanism, which is relatively simple and efficient, which affords smooth separation of ends without damage thereto, and which is suited for high-speed operation.

It is also an object of the invention to provide such a mechanism, which accommodtes substantial variation in can end spacing in the stack.

SUMMARY OF THE INVENTION

It has now been found that certain of the foregoing and related objects of the invention are readily attained in a mechanism for feeding individual can ends from a stack thereof, which ends have curled peripheral edge portions, including stacking means for disposing a multiplicity of can ends in a generally vertical stack, and gate means having a platform portion for providing underlying support for the ends disposed in the stacking means, and having an open portion through which the ends may pass. Means are provided for mounting the gate means for movement so as to sequentially align on the axis of the stacking means the platform portion and the open portion thereof. The gate means also includes a pair of elongated blades mounted in confronting relationship to one another along the opposite sides of the open portion thereof; the spacing between the blades gradually decreases from their forward ends, to cause rearward portions thereof to project beyond the adjacent margins of the open portion, and to thereby cooperatively define a tapered channel thereto. The inner edges of the forward portions of the blades are of generally wedge-shaped cross section, to provide upper and lower inclined surfaces thereon, which are preferably at an angle of 45° to the stacking axis. In addition, the blades have upper support surfaces on their rearward portions, which support surfaces are more horizontally disposed than the upper inclined surfaces of the inner edges of the forward portions, and provide ledge portions to support the stack of can ends on the blades. In addition, the blades are so disposed on the gate means as to pass between the lowermost end and the adjacent end, with the stack thereof supported on the platform portion. As a result, upon movement of the gate means from a position in which the platform portion is aligned on the stacking axis to a position in which the open portion is aligned thereon, first contact of the can ends occurs on the forward portions of the blades, with the inclined surfaces of the edge portions thereof making substantially tangential contact with the curled peripheral edge portions of the lowermost end and the end thereabove, thereby urging the ends apart. This, in turn, effects disengagement of the lowermost end so as to permit it, upon further movement of the gate means and alignment of the open portion thereof on the stacking axis, to drop thereinto while the remainder of the stack is supported upon the ledge portions of the blades.

Preferably, the gate means will be mounted for rectilinear reciprocable movement, with the platform and open portions thereof being aligned along the axis of such movement. Most advantageously, the gate means will comprise a pair of spaced, parallel, rectilinear rail members extending from the platform portion thereof along the axis of movement, the rail members having opposed recesses formed in the confronting surfaces thereof to cooperatively define the open portion of the gate means. Each of the rail members may have a narrow ledge portion extending into the recess, to provide underlying support for a can end deposited therein, and generally, the recesses will be of arcute cross section to adapte the gate means for the receipt of a circular can end. The rearward portions of the blades advantageously have generally parallel inner edges, and most desirably such rearward portions have upper and lower outer surfaces which converge to an inwardly directed, relatively thin flange, on which flange the upper support surface is defined.

In the especially preferred embodiments, the gate means comprises a transfer bar having an opening formed therein which is dimensioned and configured to seat, and to provide underlying support for, one of the end blanks, and also having a platform portion adjacent to the opening, on which the ends in the stacking means may rest. Such embodiments will include means for mounting the bar for reciprocation in a generally horizontal plane beneath the stacking means, so as to effect alternate alignment on the axis of the stacking means of the platform portion and the opening thereof. The mechanisms of the invention may additionally include vacuum means, to assist the movement of ends into the open portion.

BRIEF DESCRIPTION OF THE DRAWINGS

FIG. 1 is a fragmentary perspective view of a high-speed inverted conversion press utilizing a can end feed mechanism embodying the present invention;

FIG. 2 is a fragmentary plan view of the transfer bar of the mechanism embodied in the press of FIG. 1, drawn to an enlarged scale and showing the transfer bar at an intermediate position during retraction, with the blades just entering the stack of end blanks;

FIG. 3 is a view similar to that of FIG. 2, showing the transfer bar at its fully retracted position, with the blades fully inserted into, and supporting the stack;

FIG. 4 is a fragmentary cross-sectional view along line 4—4 of FIG. 2, drawn to an enlarged scale and showing initial contact of one blade within the stacked blanks;

FIG. 5 is a view comparable to that of FIG. 4, showing an intermediate stage in the separation sequence;

FIG. 6 is a fragmentary cross-sectional view along line 6—6 of FIG. 3, drawn to the scale of FIGS. 4 and 5 and showing complete separation of the lowermost blank, with the remainder of the stack supported on the blade;

DETAILED DESCRIPTION OF THE ILLUSTRATED EMBODIMENT

Figure 7:
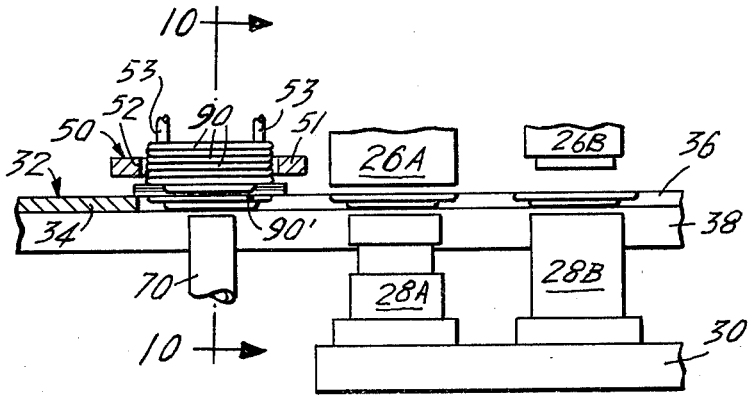
FIG. 7 is a fragmentary, vertical cross-sectional view of the transfer bar illustrated in the previous figures, drawn to a scale intermediate that of FIGS. 1, and 2 and 3, and showing the bar in its fully retracted position with the underlying platen of the press in a lowered position.

Turning now in detail to the appended drawings, therein illustrated is a can end feed mechanism embodying the present invention, and employed in a high-speed inverted conversion press. The press, shown fragmentarily in FIG. 1, includes a frame 10 (only a portion of which is shown), having four upright cylindrical posts 12 (only two being shown) to which a horizontal bolster plate (not shown) is rigidly secured. A vertically reciprocable, horizontal platen 14 is disposed beneath the bolster plate, and has corner sleeve portions 16 in which the posts 12 are slidably received.

A crankshaft 18, driven by suitable means (not shown), is rotatably mounted in the frame 10 beneath the platen 14, and has an eccentric 20 secured to it. The eccentric 20 is disposed within the guide collar portion 22 of a pitman 24, the upper end of which (not shown) is, in turn, pivotally connected (by means not shown) to the underside of the platen 14. As will be apparent, rotational movement of the shaft 18 is translated by the eccentric 20 and pitman 24 into vertical reciprocation of the platen 14.

Figure 8:
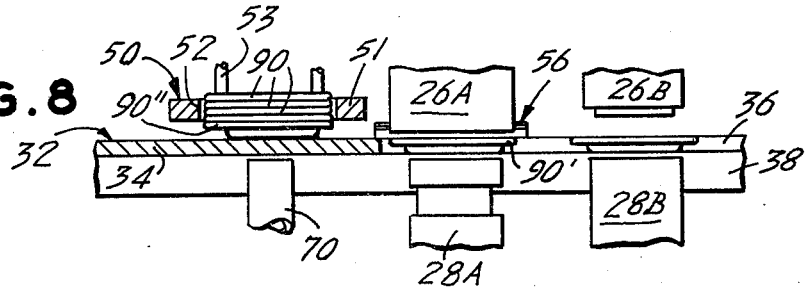
FIG. 8 is a view similar to that of FIG. 7, showing the transfer bar in its fully extended position, with the platen stroking upwardly.
Figure 9:
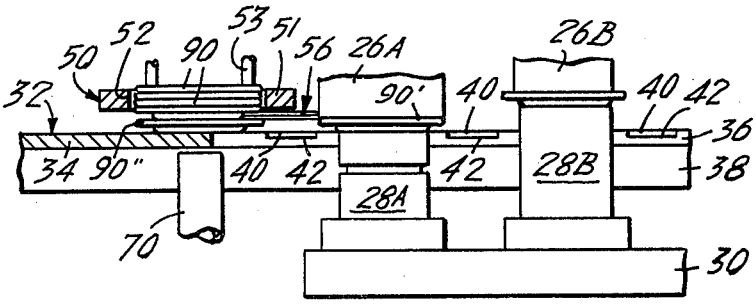
FIG. 9 is a view comparable to those of FIGS. 7 and 8, showing the transfer bar in an intermediate position, with the platen in its most elevated position.

As best illustrated in FIGS. 7 through 9, a plurality of linearly aligned end-forming die sets, consisting of upper and lower members 26, 28 (only two of which sets are depicted, for clarity of illustration) are secured by means of die shoes 30 to the lower face of the bolster plate (not shown) and the upper face 15 of the platen 14, respectively. Each set defines a work station (or, in the first position, an idle station) at which a forming operation is performed on edge-curled, circular metal blanks 90 fed thereto. In operation, the end blanks 90, supported by the lower die members 28, are lifted by the lower platen 14; forming is effected by coaction of the lower members 28 with the mating members 26 on the stationary bolster plate, which occurs at the top of the stroke of the platen 14.

The blanks 90 are successively advanced from one station to the next by a transfer bar, generally designated by the numeral 32, comprised of a platform portion 34 at one end and a pair of spaced rail members 36 extending therefrom. As will be noted, the underside of the platform portion 34 and the lower parts of the rail members 36 are configured for slidable engagement of the transfer bar 32 in upwardly opening, U-shaped tracks 38 which are, in turn, supported on the inwardly-extending shelf portions 11 of the frame 10.

A number of end-receiving pockets are defined in the rail members 36, by the provision of pairs of cooperating arcuate recesses 40, which are formed in confronting, opposed relationship therein. Within each recess 40, a ledge 42 is provided, which is dimensioned and configured to seat thereon, and to provide underlying support for, one of the end blanks 90. The pockets are spaced and aligned to correspond with the spacing and alignment of the die sets comprising the end forming stations so that, in lifting the end blanks 90 on the upstroke of the platen 14, the lower die members 28 pass upwardly through the pockets. The spacing between the rail members 36 is sufficient to permit the die members 28 to pass therethrough, thereby enabling reciprocation of the transfer bar 32 with the platen 14 in elevated positions, to achieve maximum operating speeds.

As seen in FIG. 1, the transfer bar 32 has a cam follower support block 43 projecting outwardly from the platform portion 34, on which block is carried a pair of depending cam followers 44. A cam wheel 45, having an upstanding undulating rib 46, is secured to shaft 47, with the rib 46 disposed between the cam followers 44, causing them to ride on opposite sides thereof. The shaft 47 is journaled in the frame 10 and carries a gear 48 which is in meshing engagement with the gear 49 mounted on the crankshaft 18. Accordingly, rotation of the crankshaft 18 turns the cam wheel 45, which movement is translated by the rib 46 and cam followers 44 into reciprocation of the transfer bar 32. Since the transfer bar 32 and the platen 14 are driven from a common prime mover, their operation will be synchronized.

The end blanks 90 are supplied to the transfer bar from a stacking frame, shown fragmentarily in FIG. 1 and being generally designated therein by the numberal 50. The frame 50 is comprised of a base 51 having a circular opening 52 formed therein, and four upstanding posts 53 positioned about the opening 52 for lateral constraint of the vertical stack of blanks 90. As seen from FIGS. 7 and 8, the frame 50 is supported above the transfer bar 32 (by means not shown) so that, upon reciprocation of the transfer bar 32, its vertical axis (and consequently that of the stack of ends 90) alternately aligns over the platform portion 34 of the bar 32 (FIG. 8) and the adjacent first pocket thereof (FIG. 7).

Rigidly secured to the upper surface of the rail members 36, along opposite sides of the first pocket, is a pair of elongated blades or knives, generally designated by the numeral 56. As best seen in FIGS. 4 and 5, the forwardmost portion of each of the blades 56 is defined by sloping, upper and lower surfaces 59, 60, respectively. The surfaces 59, 60 are disposed in a right angular relationship to one another to provide a wedge-shaped cross section, and they meet at a relatively sharp inner edge 58; the forward portions of the two blades 56 converge rearwardly, to thereby define a gradually tapered passageway to the underlying first pocket. Each blade 56 has a sloped upper surface 63 located rearwardly of its forward portion, which declines to a more horizontal support surface 66; an underlying horizontal surface 65 extends outwardly from the flat face of the inner edge of the blade, and merges into yet another sloped surface 64 (the angle of which is about 45° to the adjacent surface 65). Thus, an inwardly-directed, relatively thin flange is defined on each blade 56 by the surfaces 66, 65 thereof; this construction is best seen in FIG. 6.

The blades 56 are mounted, relative to the top surface 91' of the curled edge portion 92' of the lowermost end blank 90' (when supported upon the platform portion 34 of the bar 52) a distance above the bar 32 sufficient to permit the blades 56 to pass between the lowermost blank 90' and the one (90'') directly above it. In so doing, the opposite faces 59, 60 of their wedge-shaped forward portions make tangential contact with the opposite sides of their curled circumferential flanges 92', 92''; such conditions of initial entry are depicted in FIGS. 2, 4 and 9, at which point the transfer bar is at an intermediate position. As the blades 56 gradually enter further into the stack, due to the convergence of their inner edges 58 and movement of the transfer bar 32, the inclined surfaces 59, 60 progressively urge the blanks 90', 90'' from nested interengagement, causing the stack of blanks 90 thereabove to ride up the surfaces 59, as the lowermost blank 90' is separated therefrom (FIG. 5). As can be appreciated, the cooperative effect of this simple blade movement and the utilization of blades having converging edges of wedge-shaped profile affords smooth separation, while permitting substantial variation in blade-to-stack displacement without loss of the tangential relationships at initial contact. It should also be noted that, although the taper of the inclined surfaces on the forward blade portions may be varied, disposing both the upper and also the lower surfaces at angles of 45° to the horizontal axis has been found to provide an optimum balance between facility of entry and smoothness of separation.

Figure 10:
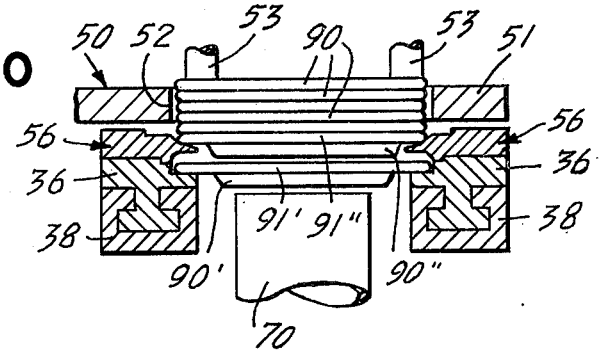
FIG. 10 is a cross-sectional view of the transfer bar of the previous Figures, taken along lines 10—10 of FIG. 7 and drawn to a scale enlarged therefrom.

Further insertion of the blades 56 shifts the inwardly-projecting flanges of the rearward portions thereof to lateral positions beneath the stack of blanks (as shown in FIGS. 6 and 10), which is thereupon supported upon the surfaces 66, with individual blanks being prevented (such as by tilting or lateral shifting) from sliding downwardly between the blades 56, and thereby jamming the mechanism. Moreover, due to the generally horizontal disposition of the upper surfaces 66, relative to that of the sloped upper surface 59, undue elevation (such as would result if the wedge-shaped profile extended along the entire length of the blade) is avoided; otherwise, the stack of ends 90 would be "jacked" up and down, significantly hampering smooth, high-speed operation.

In addition, the upper inclined surface 63 is spaced and positioned to abut or be closely adjacent to the curled edge portion 92'' of the blank 90'' (which, in FIGS. 4–6, is at the bottom of the raised stack), so as to prevent significant lateral shifting, as well as to afford additional support therefor. The lower sloped surface 64 is similarly spaced and positioned with respect to the curled edge 92' of the separated blank 90', so as to ensure that it is centered and positioned for a smooth transfer to the first pocket of the bar 32. As can be seen best in FIG. 3, the platform portion 34 of the transfer bar 32 has a concave inner edge 33 which is suitably spaced, relative to the blades 56 and the first pocket, to permit the lowermost blank 90' to drop downwardly as soon as it is separated from the stack. As a result, the blank 90' is practically fully seated in the first pocket when alignment of the first pocket with the stacking frame is achieved. This, in turn, promotes the attainment of higher operational speeds. In short, when the transfer bar 32 reaches its fully retracted position (shown in FIGS. 3, 6, 10), the separated blank 90' is deposited within the first pocket, which is then aligned under the stacking frame 50, and the blanks thereabove are supported on the upper surfaces 63, 66 of the rearward portion of the blades 56. Upon extension of the bar 32 (to the position of FIG. 8), the remaining blanks drop to the platform portion 34 and into position for entry of the blades 56, for feeding of the next blank 90''.

Transfer of the end blanks 90 to the first pocket may be assisted by a downdraft, or pressure differential, established through a vacuum pipe 70, which is supported (by means not shown) below the transfer bar 32 and the stacking frame 50, and which communicates with a vacuum source (not shown). As can be appreciated, utilization of the downdraft to facilitate the feeding of end blanks to the transfer bar will promote maximum press speeds.

Turning now particularly to FIGS. 7-9 of the drawings, the advance of the end blanks to each of the forming stations is depicted therein. When the transfer bar 32 is fully retracted (FIG. 7), the blank 90' has been separated from the bottom of the stack, and is seated in the first pocket adjacent the platform portion 34; the blades 56 support the remainder of the stack upon the upper surfaces 63, 66 of their rearward portions. Forward movement of the transfer bar (i.e., to the right in the drawing) to its fully extended position (FIG. 8) advances blank 90' to the first station, defined by lower member 28A and upper member 26A, with the remainder of the stack of blanks being supported by the platform portion 34, which has been shifted to a position thereunder by such forward movement. In this phase of operation, the platen 14 is on its upstroke, and member 28A is lifting the blank 90' to clear the first pocket, and to bring it into clamping coaction with the upper member 26A. With the blank clamped between the members 26A and 28A, the bar 32 returns to its retracted position to pick up the next blank; the return phase and clamping action are illustrated in FIG. 9.

When the transfer position of FIG. 7 is again attained, it will be appreciated that the blank 90' will have been lowered on the member 28A into the second pocket, and that another blank will have been separated from the stack and deposited into the first. In this manner, each blank is transferred from the stack to the sequential pockets by the cooperative action of the bar 32 and the members 26, 28, A, B, etc., so that a succession of blanks is moved from station to station while the transfer bar shuttles therethrough.

While the instant feed mechanism has been described in relation to the illustrated and preferred embodiment, it should be understood that modifications may be made, as will be apparent to those skilled in the art. For example, while it is preferred that the mechanism be rectilinearly reciprocable, it may instead be adapted for rotary movement. This might be accomplished by using a pair of wheels mounted adjacent to one another and rotatable in opposite directions, in place of the transfer bar. Each wheel would have a plurality of indentations or recesses formed in its circumference, and the wheels would be so mounted that, upon rotation, the recesses would be brought into cooperative, pocket-defining positions. In such a case, the blades would be appropriately modified to perform the functions hereinbefore described. The feed mechanism could also take the form of endless belts or the like, two of which would cooperate to define the necessary pockets. Finally, it should be pointed out that, although the instant feed mechanism is especially valuable in affording facile feeding of edge-curled circular can ends, a suitably configured mechanism may be employed for non-circular ends.

Thus, it can be seen that the present invention provides a novel can end feeding mechanism which is relatively simple, efficient and suitable for use at high-speeds, which accommodates wider variation in can end spacing in the stack, and which affords smooth separation of ends fed thereby without damage thereto.

What is claimed is:

1. In a mechanism for feeding individual can ends from a stack thereof, which ends have curled peripheral edge portions, the combination comprising: stacking means for disposing a multiplicity of can ends in a generally vertical stack; gate means having a platform portion for providing underlying support for the ends disposed in said stacking means, and having an open portion through which the ends may pass; and means for mounting said gate means for movement so as to sequentially align on said axis of said stacking means said platform portion and said open portion thereof, said gate means including a pair of elongated blades mounted in confronting relationship to one another along the opposite sides of said open portion thereof, the spacing between said blades gradually decreasing from their forward ends, to cause rearward portions thereof to project beyond the adjacent margins of said open portion and to thereby cooperatively define a tapered channel thereto, the inner edges of said forward portions of said blades being of generally wedge-shaped cross section to provide upper and lower inclined surfaces thereon, said blades also having upper support surfaces on said rearward portions thereof, which support surfaces are more horizontally disposed than said upper inclined surfaces of said inner edges, to provide ledge portions for support of the stack of can ends on said blades, said blades being so disposed on said gate means as to pass between the lowermost end and the adjacent end with the stack thereof supported on said platform portion, and so that, upon movement of the gate means from a position in which said platform portion is aligned on said stacking axis to a position in which said open portion is aligned thereon, first contact of the can ends occurs on said forward portions of said blades, with said inclined surfaces of said edge portions thereof making substantially tangential contact with the curled peripheral edge portions of the lowermost end and the end thereabove, thereby urging the end apart and effecting disengagement of the lowermost end so as to permit it, upon further movement of said gate means and alignment of said open portion thereof on said stacking axis, to drop thereinto while the remainder of the stack is supported upon said ledge portions of said blades.

2. The mechanism of claim 1 wherein each of said inclined surfaces of said forward portions of said blades is at an angle of about forth-five degrees to said stacking axis.

3. The mechanism of claim 1 additionally including vacuum means to assist the movement of ends into said opening.

4. The mechanism of claim 1 wherein said gate means is mounted for rectilinear reciprocable movement, and wherein said platform and open portions thereof are aligned on the axis of such movement.

5. The mechanism of claim 4 wherein said gate means comprises a pair of spaced, parallel, rectilinear rail members extending from said platform portion thereof along said axis of movement, said rail members having opposed recesses formed in the confronting surfaces thereof to cooperatively define said open portion of said gate means.

6. The mechanism of claim 5 wherein each of said rail members has a narrow ledge portion extending into said recess, to provide underlying support for a can end deposited therein.

7. The mechanism of claim 5 wherein said recesses of said rail members are of arcuate cross section to adapt said gate means for the receipt of a circular can end.

8. The mechanism of claim 1 wherein said rearward portions of said blades have generally parallel inner edges.

9. The mechanism of claim 1 wherein said rearward portion of each of said blades has upper and lower outer surfaces which converge to an inwardly directed, relatively thin flange on which said upper support surface is defined.

10. In a mechanism for feeding individual can ends from a stack thereof, which ends have curled peripheral edge portions, the combination comprising: stacking means for disposing a multiplicity of can ends in a generally vertical stack; a transfer bar for providing underlying support for the ends in said stacking means, and for individually releasing ends therefrom, said transfer bar having an opening formed therein which is dimensioned and configured to seat, and to provide underlying support for, one of the end blanks, and having a platform portion adjacent to said opening on which the ends in said stacking means may rest; and means for mounting said bar for reciprocation in a generally horizontal plane beneath said stacking means, so as to alternately align on the axis of said stacking means said platform portion and said opening thereof, said transfer bar also including a pair of elongated blades mounted in confronting relationship to one another along the opposite sides of said opening therein, the spacing between said blades gradually decreasing from their forward ends, to cause rearward portions thereof to project beyond the adjacent margins of said opening and to thereby cooperatively define a tapered channel thereto, the inner edges of said forward portions of said blades being of generally wedge-shaped cross section to provide upper and lower inclined surfaces thereon, said blades also having upper support surfaces thereon on said rearward portions thereof, which support surfaces ae more horizontally disposed than said upper inclined surfaces of said inner edges to provide ledge portions for support of the stack of can ends on said blades, said blades being so disposed on said transfer bar as to pass between the lowemost end and the adjacent end with the stack thereof supported on said platform portion, and so that, upon movement of said bar from a position in which said platform portion is aligned on said stacking axis to a position in which said opening is aligned thereon, first contact of the can ends occurs on said forward portions of said blades, with said inclined surfaces of said edge portions thereof making substantially tangential contact with the curled peripheral edge portions of the lowermost end and the end thereabove, thereby urging the ends apart and effecting disengagement of the lowermost end so as to permit it, upon further movement of said transfer bar and alignment of said opening thereof on said stacking axis, to drop thereinto while the remainder of the stack is supported upon said ledge portions of said blades.

11. The mechanism of claim 10 wherein each of said inclined surfaces of said forward portions of said blades is at an angle of about 45 degrees to said stacking axis.

12. The mechanism of claim 10 additionally including vacuum means to assist the movement of ends into said opening.

13. The mechanism of claim 10 wherein said transfer bar is mounted for rectilinear movement, and wherein said platform and open portions thereof are aligned on the axis of such movement.

14. The mechanism of claim 13 wherein said transfer bar comprises a pair of spaced, parallel, rectilinear rail members extending from said platform portion thereof along said axis of movement, said rail members having opposed recesses formed in the confronting surfaces thereof to cooperatively define said opening thereof.

15. The mechanism of claim 14 wherein each of said rail members has a narrow ledge portion extending into said recess, to provide underlying support for a can end deposited therein.

16. The mechanism of claim 15 wherein said recesses of said rail members are of arcuate cross section to adapt said transfer bar for the receipt of a circular can end.

17. The mechanism of claim 10 wherein said rearward portions of said blades have generally parallel inner edges.

18. The mechanism of claim 10 wherein said rearward portion of each of said blades has upper and lower outer surfaces which converge to an inwardly directed, relatively thin flange on which said upper support surface is defined.

* * * * *